US010905942B2

(12) United States Patent
Pham

(10) Patent No.: US 10,905,942 B2
(45) Date of Patent: Feb. 2, 2021

(54) BOARD GAME DIAL

(71) Applicant: Chuong Pham, Dorchester, MA (US)

(72) Inventor: Chuong Pham, Dorchester, MA (US)

( * ) Notice: Subject to any disclaimer, the term of this patent is extended or adjusted under 35 U.S.C. 154(b) by 0 days.

(21) Appl. No.: 16/427,200

(22) Filed: May 30, 2019

(65) Prior Publication Data

US 2020/0330855 A1 Oct. 22, 2020

Related U.S. Application Data

(63) Continuation-in-part of application No. 29/687,896, filed on Apr. 17, 2019.

(51) Int. Cl.

| | |
|---|---|
| ***A63F 3/00*** | (2006.01) |
| ***A63F 11/00*** | (2006.01) |
| ***G09F 11/04*** | (2006.01) |

(52) U.S. Cl.

CPC ..... *A63F 11/0051* (2013.01); *G09F 11/04* (2013.01); *A63F 2011/0062* (2013.01)

(58) Field of Classification Search

CPC ..... A63F 11/0051; A63F 2011/0062; G09F 11/04

USPC ..... 273/141 A, 148 R, 280, 142 R, 142 H, 273/142 HA, 145 D, 145 E

See application file for complete search history.

(56) References Cited

U.S. PATENT DOCUMENTS 4,714,429 A * 12/1987 Phillips ..... G09B 19/02 434/198
4,941,665 A * 7/1990 Klamer ..... A63F 5/04 273/142 H
6,142,784 A * 11/2000 Wood ..... G09B 5/065 434/188

* cited by examiner

*Primary Examiner* — Vishu K Mendiratta
(74) *Attorney, Agent, or Firm* — Christopher Pilling

(57) ABSTRACT

A board game dial for use with a board game includes a cylindrical body having a top surface. A first attribute track extending from the top surface is provided, wherein the first attribute track having a first plurality of numerical values representing a first attribute for a game player. A second attribute track is provided having a second plurality of numerical values representing a second attribute for the game player. A third attribute track is provided having a second plurality of numerical values representing a third attribute for the game player. The top surface is magnetic enabling a magnetic game character piece or a magnetic or non-magnetic token to attach to the top surface such that the board game dial is identified with a game player.

12 Claims, 5 Drawing Sheets

BOARD GAME DIAL

CROSS-REFERENCE TO RELATED APPLICATIONS

The present invention is a continuation in part to U.S. Design patent application Ser. No. 29/687,896 filed Apr. 17, 2019 which is hereby incorporated in its entirety at least by reference.

BACKGROUND OF THE INVENTION

1. Field of the Invention

The present invention relates to game attribute tracking methods and more particularly to a board game dial.

2. Description of Related Art

In many board games, players must keep track of a variety of different attributes during game play. Some examples of attributes include health, power, damage, armor, magic, victory points, and other numerical values associated with a particular player or character in a board game. There are many different solutions, and methods to track these attributes, however most track only one or two attributes, take up large areas of space, and are not able to be integrated in game play. Consequently, there is a need for a compact board game dial that can track several attributes and be able to be integrated in game play.

BRIEF SUMMARY OF THE INVENTION

In one embodiment of the present invention a board game dial for use with a board game comprising a cylindrical body having a top surface; a first attribute track extending from the top surface, wherein the first attribute track having a first plurality of numerical values representing a first attribute for a game player; a second attribute track having a second plurality of numerical values representing a second attribute for the game player; and, a third attribute track having a second plurality of numerical values representing a third attribute for the game player.

In one embodiment, the first attribute track is stationary. In one embodiment, a sliding element is provided and configured to slide around the first attribute track such that a first numerical value of the first plurality of numerical values may be selected. In one embodiment, the second attribute track is configured to rotate. In another embodiment, the rotatable second attribute track is arranged within the cylindrical body such that only a second numerical value of the second plurality of numerical values is visible. In one embodiment, the rotatable second attribute track is rotatable via a gear system. In one embodiment, the third attribute track is configured to rotate. In one embodiment, the rotatable second attribute track is arranged within the cylindrical body such that only a third numerical value of the third plurality of numerical values is visible. In another embodiment, the rotatable third attribute track includes traction members to aid a user during rotation. In one embodiment, the top surface is magnetic enabling a magnetic game character piece or token to attach to the top surface such that the board game dial is identified with the game player. In yet another embodiment, the board game dial is used as a playable character piece in the board game. In one embodiment, a first, second, and third insignia is provided defining the specific attribute for the first, second, and third attribute track respectively.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
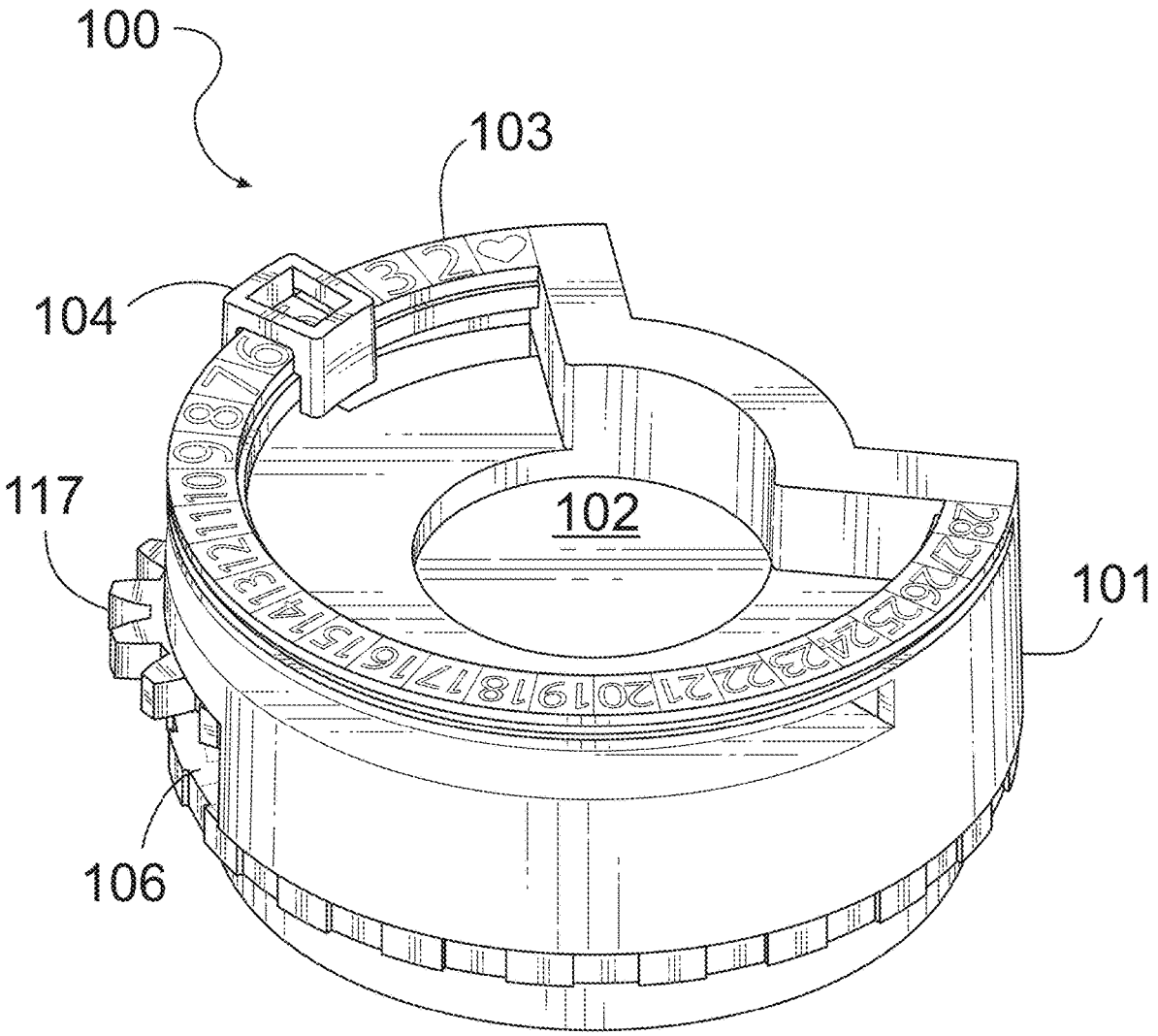
FIG. 1 is a front, left, top perspective view of a board game dial according to an embodimentof the present invention.
Figure 2:
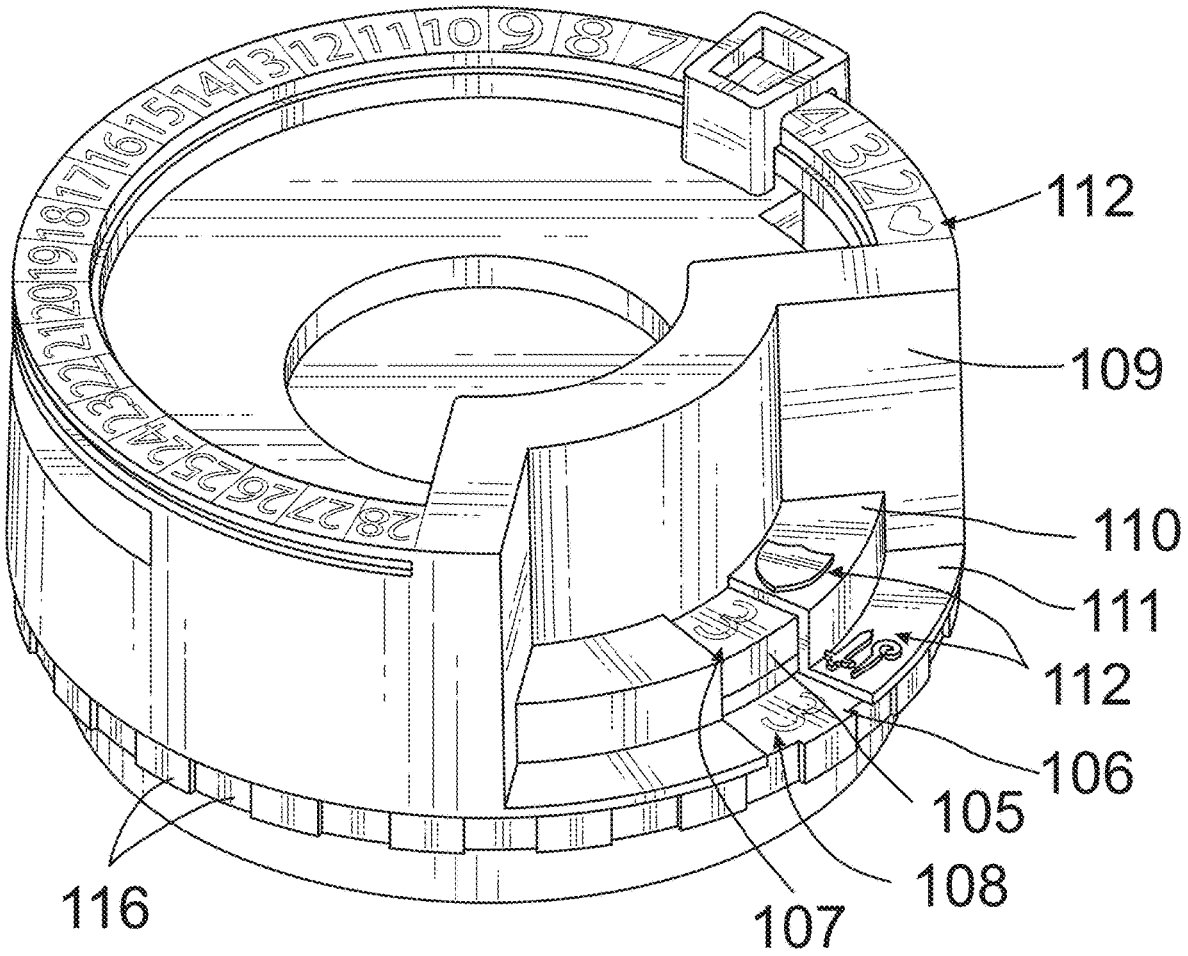
FIG. 2 is a front, right, top perspective view of the board game dial according to an embodiment of the present invention.
Figure 3:
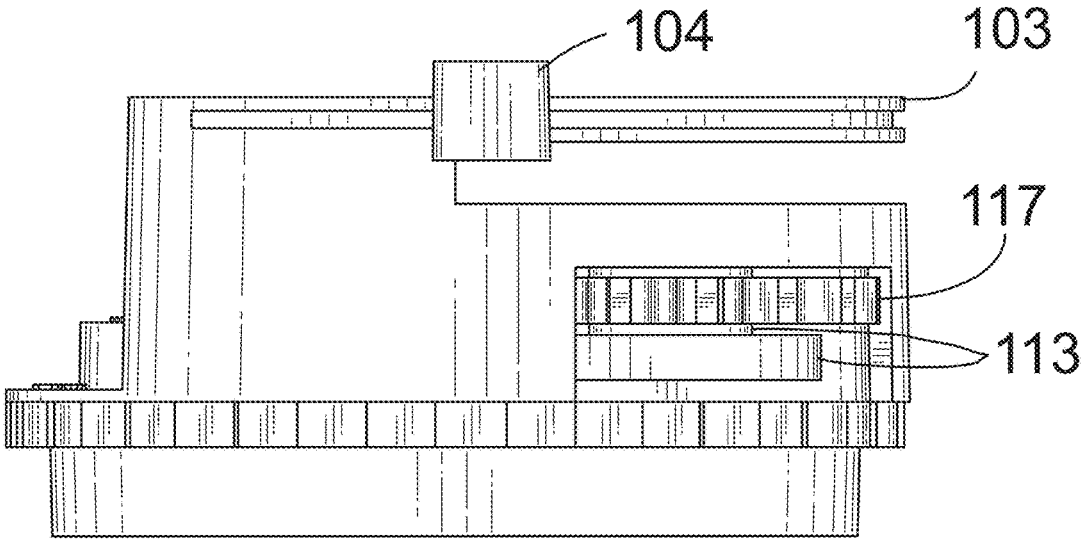
FIG. 3 is a back view of the board game dial according to an embodiment of the present invention.
Figure 4:
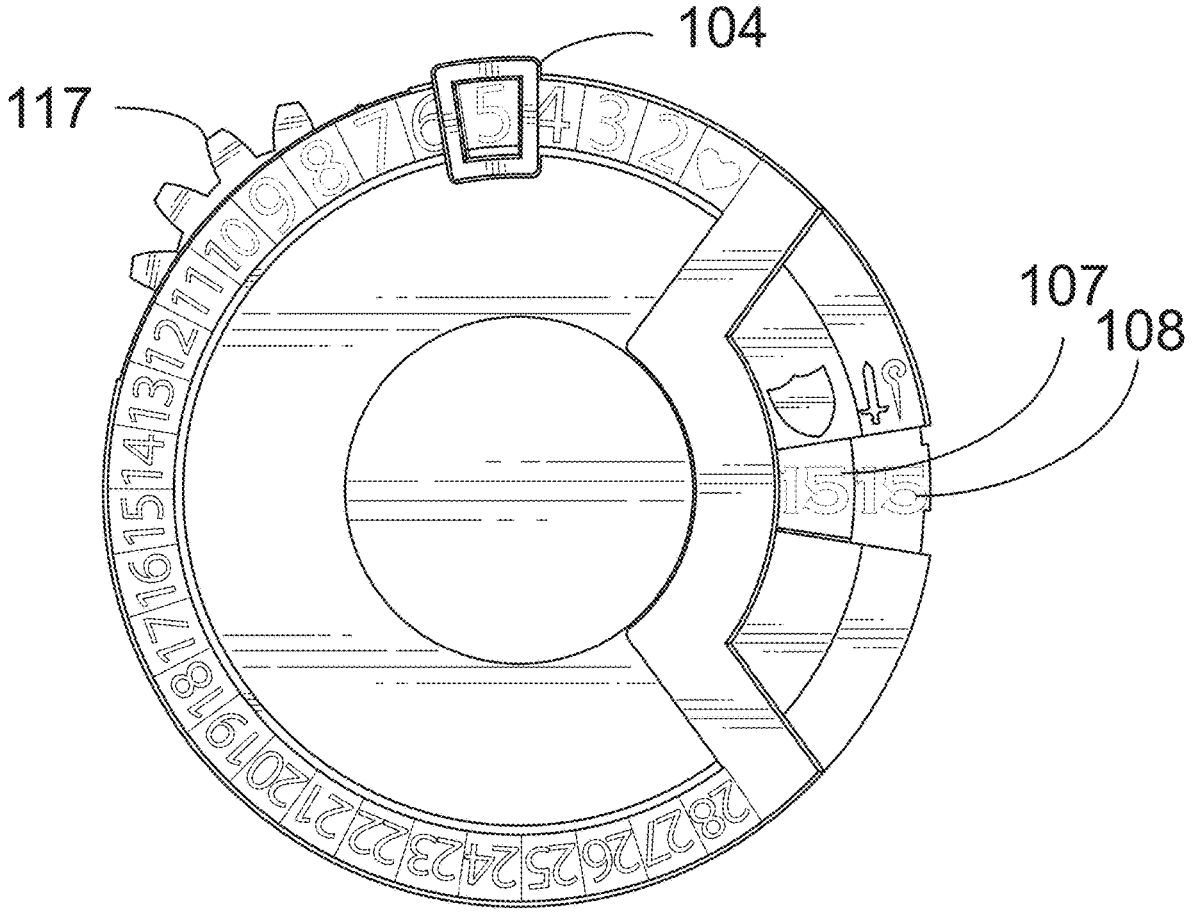
FIG. 4 is a top view of the board game dial according to an embodiment of the present invention.

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a board game dial.

FIGS. 1-6 illustrate various views of a board game dial 100. Referring to FIGS. 1-5, the board game dial comprises a cylindrical body 101, a first attribute track 103, a second attribute track 105, and a third attribute track 106. In one embodiment, the cylindrical body has a top surface having a magnetic portion 102. In some embodiments, the magnetic portion is recessed or indented in the top surface of the cylindrical body. The first, second, and third attribute tracks include a first, second, and third plurality of numerical values. In some embodiments, the first, the second, and the third attribute tracks are ringed shaped. In a preferred embodiment, the numerical values are in ascending or descending order by a value of 1. However, it is understood that the numerical values may be in ascending or descending order by any value, pattern, or sequence know in the art. Yet further, in alternative embodiments, one or more attribute tracks may be provided with symbols, insignias, colors, words, shapes, etc. rather than numerical values.

In one embodiment, the first attribute track is stationary, wherein the first attribute track is extended from the top surface of the cylindrical body such that a slider element 104 is operable to slide around the first attribute track. The extended first attribute track creates a slot between the top surface of the cylindrical body and the first attribute track. The slider element is configured to slide and select a single numerical value of the plurality of numerical values at any given time.

In one embodiment, the second attribute track is arranged within the cylindrical body and configured to rotate such that only a single numerical value 107 of the second plurality of numerical values is visible. In one embodiment, the second attribute track is rotated by a user using gear system 113 and adjustment control element 117, wherein the adjustment control element is configured to protrude from the cylindrical body for ease of operation for the user, such as with the use of the user's index finger. Similarly, the third attribute track is arranged within the cylindrical body and configured to rotate such that only a single numerical value 108 of the third plurality of numerical values is visible. In one embodiment, the third attribute track includes traction members 116 to aid the user during rotation.

In one embodiment, the cylindrical body includes a cutout portion 109 having a first 110 and a second level 111 corresponding to the second attribute track and third attribute track respectively. The cutout portion enables the user to easily see the visible numerical values associated of the second and third attribute tracks. Also provided is a plurality of insignia 112, wherein the insignia is a color, symbol, word, etc. representing what each attribute track represents such as health, power, damage, armor, magic, victory points, and other numerical values associated with a particular player or character in a board game.

It is a particular advantage of the present invention for the board game dial to be used in actual game play. In one embodiment, the magnetic portion on the top surface enables a magnetic game character piece 120 (FIG. 6) to attach to the top surface such that the board game dial is identified with a specific game player. In some embodiments, in combination with the attached character, the board game dial is used as a playable character piece in the board game. In some embodiments, a character token 121 (FIG. 6) may be inserted into the magnetic portion or top portion of the cylindrical body. The tokens or magnetic game character pieces are designed to be interchangeable. Ideally, each player playing the game has a board game dial, wherein the character piece or token attached to the board game dial distinguishes the different characters from each other. In alternative embodiments, each board game dial may be marked with an identifying mark, such as color to distinguish between different characters. In some embodiments, an identification set may be provided on the cylindrical body, wherein the identification set consists of: an alphanumeric identification, a symbolic shape, a company brand, a numeric identification number, a QR code, a barcode, and an RFID tag. In one embodiment, the QR code can lead a user to game instructions and/or operating instructions for the board game dial.

In the preferred embodiment, during use, a user selects a board game dial then attaches their character to the top surface as previously discussed. Then based on the character selected, the first, second, and third attribute tracks is adjusted for the starting position defined by that specific character. Then during game player the attribute tracks are adjusted as necessary and when appropriate during the game as well known in the art. Further, the board game dial can be used and moved around the game board as a character playing piece.

One exemplary use will now be described. In this embodiment, the first attribute track is a character's health, the second attribute track is the character's defense, and the third attribute is the character's attack points, wherein the dial itself may act like a chess piece during game play.

The material of the game board dial may be any suitable material known in the art. Although three attribute tracks are provided, it should be understood that more attribute tracks may be provided such that more attributes may be tracked. Advantageously, if desired, some attribute tracks may be hidden from other players, such as the second and third attribute tracks situated in the cutout 109.

Figure 5:
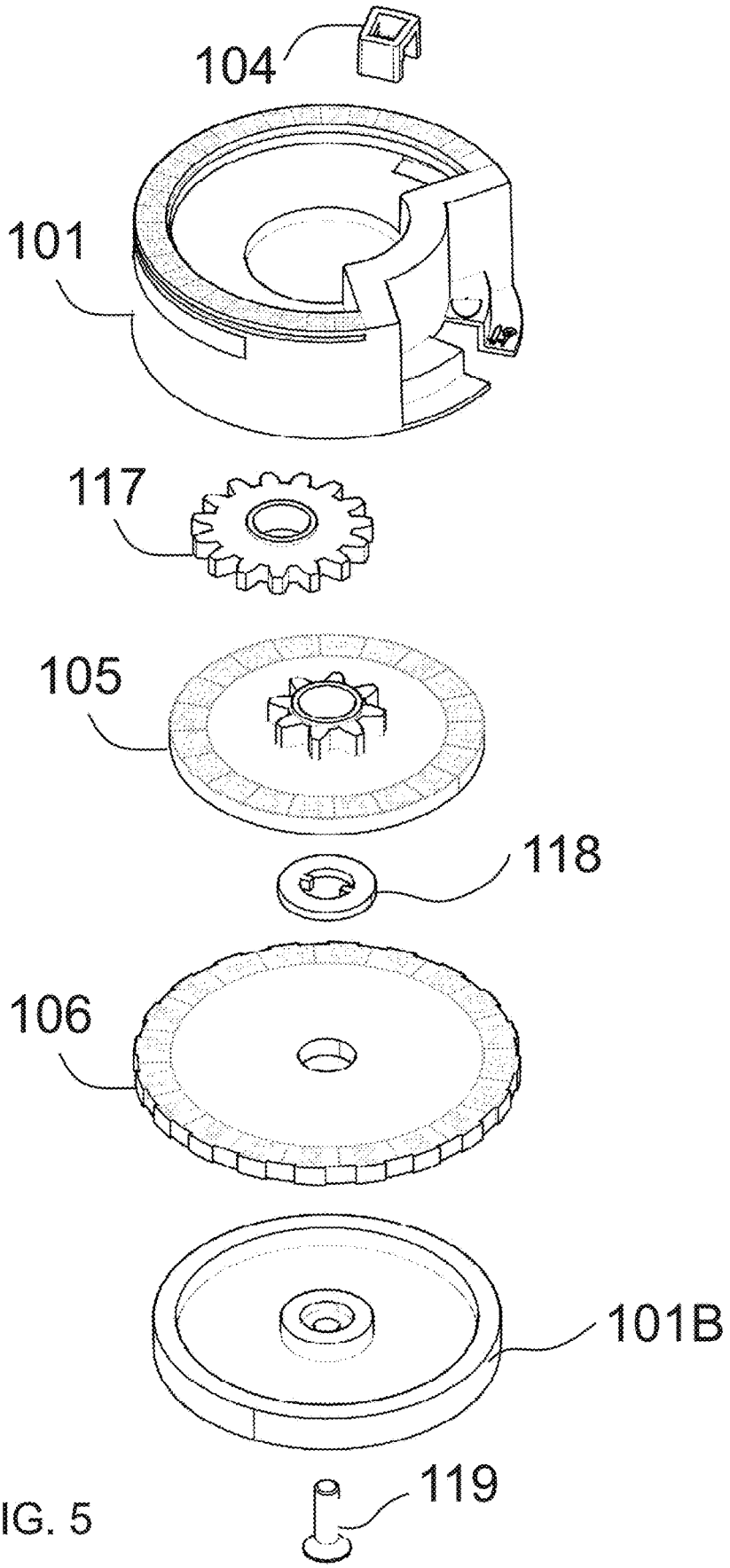
FIG. 5 is an exploded view of the board game dial according to an embodiment of the present invention; and, FIG. 6 is a perspective view illustrating an exemplary character piece and token according to an embodiment of the present invention.
Figure 6:
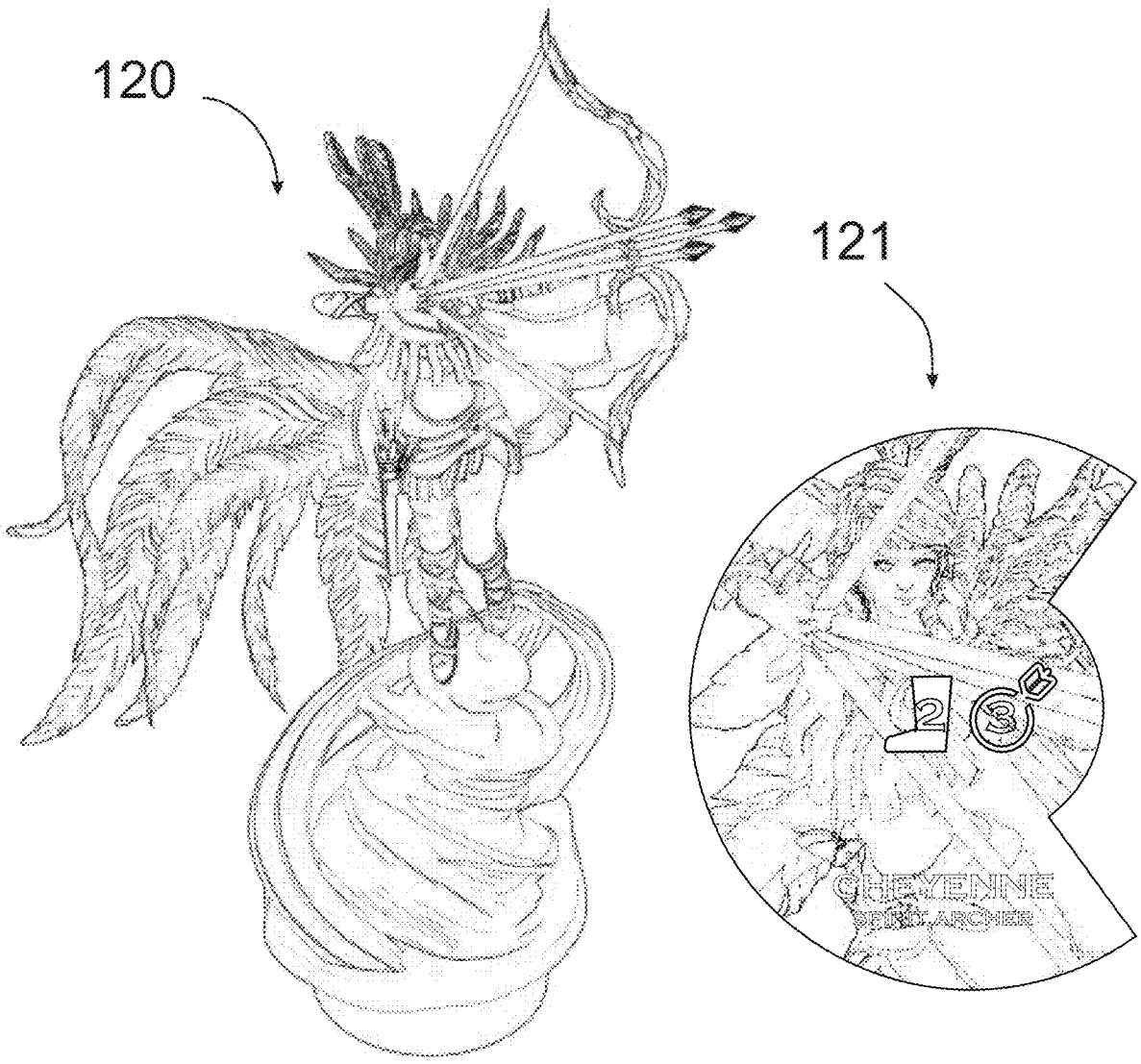

The construction of the board game dial, best seen in FIG. 5, includes pin 119, washer 118 securing the cylindrical body 101, the second attribute track 105, the third attribute track 106, and the bottom cylindrical body 101B into the present invention.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For instance, the magnetic portion may be another means of connection with the character piece, including but not limited to snap fit, Velcro, button, It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A board game dial for use with a board game comprising:

a cylindrical body having a top surface;

a first attribute track extending from the top surface, wherein the first attribute track having a first plurality of numerical values representing a first attribute for a game player;

a second attribute track having a second plurality of numerical values representing a second attribute for the game player;

a third attribute track having a third plurality of numerical values representing a third attribute for the game player; and, wherein the top surface is magnetic enabling a magnetic game character piece or token to attach to the top surface such that the board game dial is identified with the game player.

2. The board game dial of claim 1, wherein the first attribute track is stationary.

3. The board game dial of claim 2, further comprising a sliding element configured to slide around the first attribute track such that a first numerical value of the first plurality of numerical values may be selected.

4. The board game dial of claim 1, wherein the second attribute track is configured to rotate.

5. The board game dial of claim 4, wherein the rotatable second attribute track is arranged within the cylindrical body such that only a second numerical value of the second plurality of numerical values is visible.

6. The board game dial of claim 5, wherein the rotatable second attribute track is rotatable via a gear system.

7. The board game dial of claim 1, wherein the third attribute track is configured to rotate.

8. The board game dial of claim 7, wherein the rotatable third attribute track is arranged within the cylindrical body such that only a third numerical value of the third plurality of numerical values is visible.

9. The board game dial of claim 8, wherein the rotatable third attribute track includes traction members to aid a user during rotation.

10. The board game dial of claim 1, wherein the board game dial is used as a playable character piece in the board game.

11. The board game dial of claim 1, further comprising a first, second, and third insignia defining the specific attribute for the first, second, and third attribute track respectively.

12. A board game dial for use with a board game comprising:

a cylindrical body having a top surface;

a first attribute track extending from the top surface, wherein the first attribute track having a first plurality of numerical values representing a first attribute for a game player;

a second attribute track having a second plurality of numerical values representing a second attribute for the game player, wherein the second attribute track is configured to rotate via a gear system and is arranged within the cylindrical body such that only a second numerical value of the second plurality of numerical values is visible; and, a third attribute track having a third plurality of numerical values representing a third attribute for the game player.

* * * * *